US007654390B2

(12) United States Patent
Baechle et al.

(10) Patent No.: US 7,654,390 B2
(45) Date of Patent: Feb. 2, 2010

(54) MEANS FOR SECURING A TRANSPORT BASE TO A SHIPPING PALLET

(75) Inventors: James R Baechle, Gallatin, TN (US); Matthew Marrow, Medina, TN (US); Edward L Lake, Franklin, TN (US)

(73) Assignee: Sonoco Development Inc., Hartsville, SC (US)

( * ) Notice: Subject to any disclaimer, the term of this patent is extended or adjusted under 35 U.S.C. 154(b) by 305 days.

(21) Appl. No.: 11/737,383

(22) Filed: Apr. 19, 2007

(65) Prior Publication Data

US 2008/0257769 A1 Oct. 23, 2008

(51) Int. Cl.

| | |
|---|---|
| ***B65D 19/00*** | (2006.01) |
| ***B65D 85/30*** | (2006.01) |
| ***B65D 5/12*** | (2006.01) |
| ***B65D 5/32*** | (2006.01) |
| ***B65D 19/44*** | (2006.01) |
| ***B65D 88/00*** | (2006.01) |

(52) U.S. Cl. ..... 206/386; 206/591; 206/599; 229/122.27; 108/55.1; 220/1.5

(58) Field of Classification Search ..... 206/386, 206/595–600, 591, 594; 220/1.5; 229/125.21, 229/122.27; 108/57.33, 56.3, 55.1
See application file for complete search history.

(56) References Cited

U.S. PATENT DOCUMENTS

| | | | | |
|---|---|---|---|---|
| 1,496,888 | A * | 6/1924 | Kalinowski | 30/164.7 |
| 2,633,982 | A | 4/1953 | Addison | |
| 2,804,253 | A * | 8/1957 | Brandt | 206/320 |
| 3,066,842 | A | 12/1962 | Croley | |
| 3,294,306 | A | 12/1966 | Areddy | |
| 3,424,364 | A * | 1/1969 | Grafslund | 206/340 |
| 3,708,861 | A | 1/1973 | Hickey | |
| 4,013,168 | A * | 3/1977 | Bamburg et al. | 206/386 |
| 4,383,609 | A * | 5/1983 | Lochmiller | 206/386 |
| 4,610,355 | A * | 9/1986 | Maurer | 206/386 |
| 4,729,505 | A * | 3/1988 | Remaks et al. | 229/109 |
| 4,976,353 | A * | 12/1990 | Halliday | 206/386 |
| 5,350,066 | A | 9/1994 | Mendoza et al. | |
| 5,704,488 | A * | 1/1998 | Smith | 206/598 |
| 5,896,995 | A * | 4/1999 | Murray et al. | 206/736 |
| 7,128,209 | B2 * | 10/2006 | Bringard et al. | 206/386 |
| 2007/0023319 | A1 * | 2/2007 | Honkawa et al. | 206/600 |

FOREIGN PATENT DOCUMENTS

| | | | |
|---|---|---|---|
| EP | 202363 | A1 * | 11/1986 |
| FR | 2598684 | A1 * | 11/1987 |
| GB | 1496888 | A * | 1/1978 |

* cited by examiner

*Primary Examiner*—Mickey Yu
*Assistant Examiner*—Melissa L Lalli
(74) *Attorney, Agent, or Firm*—Miller Matthias and Hall

(57) ABSTRACT

A unitary palletized packaging assembly for securing a packaged article to a wooden shipping pallet is provided. The article is assembled on a paperboard base and then after assembly enclosed in an open bottomed carton and placed on a shipping pallet. The transport base and carton each have bottom flaps that are folded downward and stapled to the sides of the shipping pallet in overlapping fashion to prevent lateral movement of the transport base and packaged article with respect to the shipping pallet. The transport base includes cushioning elements to cushion and support the article.

11 Claims, 3 Drawing Sheets

MEANS FOR SECURING A TRANSPORT BASE TO A SHIPPING PALLET

BACKGROUND

1. Field of the Invention

This patent relates to a palletized packaging assembly. More particularly, this patent relates to a packaging assembly in which the outer carton and the manufacturing transport base are secured to the shipping pallet to prevent lateral movement of the packaged article relative to the shipping pallet.

2. Description of the Related Art

Articles such as outside air conditioners or large household appliances (washers, dryers, ranges, etc.) are often carried along assembly lines on transport bases made of corrugated fiberboard, honeycomb, foam or a combination of these materials. When these units are boxed and placed on shipping pallets (skids), they tend to shift, causing the boxed article to overhang the edges of the shipping pallet, sometimes resulting in damage to the packaged article and/or stacking and handling difficulties.

Thus the primary object of the present invention is to provide a packaging system that prevents a boxed article from the shifting with respect to the shipping pallet on which it rests.

Another object of the invention is to provide a shipping package in which the manufacturing transport base and outer box or carton are secured to the shipping pallet to prevent shifting of the product on the shipping pallet.

Further and additional objects will appear from the description, accompanying drawings, and appended claims.

SUMMARY OF THE INVENTION

The present invention is unitary palletized assembly for packaging an article in which a manufacturing transport base and an outer carton are removably secured to a shipping pallet to prevent movement of the packaged article with respect to the shipping pallet in any lateral (horizontal) direction.

The packaging assembly comprises three main components: a shipping pallet, typically made of wood, a composite manufacturing transport base that rests on the pallet, and an open bottom carton that surrounds and protects the sides and top of the packaged article. Corner posts may be inserted inside the carton between the carton and the packaged article for lateral impact protection and axial strength. The article to be packaged can be any large article, such as an air conditioning unit or a large household appliance.

The shipping pallet has a load bearing surface, typically defined by a plurality of parallel cross members, which are themselves supported by two parallel runners. Elongated front and rear stops are affixed to opposing ends of the shipping pallet. The carton and transport base are wedged between the front and rear stops to prevent lateral movement of the packaged article in two directions (forward and rearward).

The transport base is substantially rectangular and comprises a bottom panel having a perimeter defined by first and second sets of opposing fold lines, front and rear panels hingedly attached to the bottom panel along one set of opposing fold lines, and side panels hingedly attached to the bottom panel along the other set of opposing fold lines. A plurality of load bearing cushioning elements are arranged in spaced relation near the perimeter of the bottom panel for supporting and cushioning the packaged article. The front and rear panels are folded upward and inward to at least partially encapsulate the cushioning elements.

The carton, when placed over the article and transport base, encloses the four sides of the transport base and extends upwardly therefrom. The carton comprises four side walls, four top flaps and four relatively narrower bottom flaps. The bottom flaps consist of front and rear flaps and two side flaps and are narrower than the top flaps.

In the assembled package the carton front and rear flaps are folded or tucked under the transport base and are interposed between the transport base and the shipping pallet during shipping. The carton side flaps extend downward, over the transport base side panels, and are secured to the shipping pallet runners by staples or other attachment means, with the transport base side flaps sandwiched and secured therebetween.

The assembled package is referred to as "unitary" because the carton, manufacturing transport base and shipping pallet are secured together to form a stable unit.

THE DRAWINGS

DETAILED DESCRIPTION OF THE INVENTION

Figure 1:
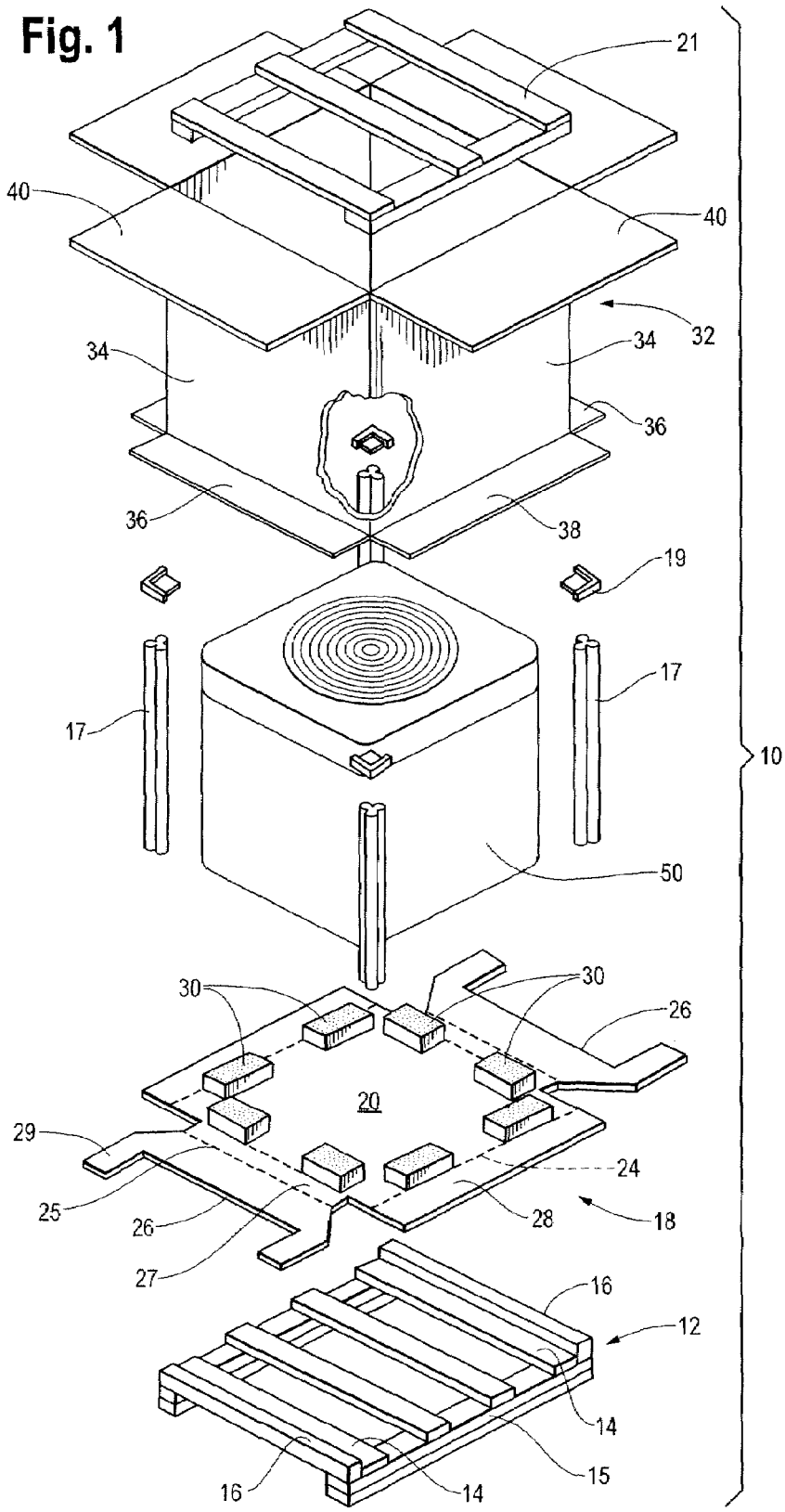
FIG. 1 is an exploded view of a unitary palletized packaging assembly according to the present invention.

While this invention may be embodied in many forms, there is shown in the drawings and will herein be described in detail one or more embodiments, with the understanding that this disclosure is to be considered an exemplification of the principles of the invention and is not intended to limit the invention to the illustrated embodiment(s). Although the invention will now be described as a packaging assembly for an air conditioner, it should be understood that the invention can be used to package other articles, including but not limited to large household appliances.

Turning to the drawings, there is shown in FIG. 1 an exploded view of one embodiment of the present invention, a unitary palletized packaging assembly 10 in which a carton 32 and manufacturing transport base 18 are secured to a shipping pallet 12 to prevent lateral (horizontal) movement of the packaged article 50 with respect to the shipping pallet 12. The packaging assembly 10 comprises three main components: the shipping pallet 12, typically made of wood, a composite manufacturing transport base 18 that rests on the pallet 12, and an open bottom carton 32 that is placed over the article 50 and transport base 18 while or after the article is assembled. Optional corner posts 17 may be inserted between the carton 32 and the packaged article 50 for protecting the article 50 from impact forces and providing axial compression strength to the overall package 10. Other optional components include corner post caps 19 mounted to the top ends of the corner posts 17 and a top frame 21, both of which are the subject of a co-pending and co-owned patent application.

The article 50 to be packaged can be any large article, such as the air conditioning unit depicted in FIG. 1. The article 50 typically rests on the transport base 18 during manufacture, with the transport base 18 ultimately functioning as the bottom of the carton 32. By wedging the carton 32 and transport base 18 between two opposing end stops 16 which form part of the shipping pallet 12, and by securing the carton side bottom flaps 38 and transport base side panels 28 to the sides of the shipping pallet 12, the packaged article cannot move laterally relative to the shipping pallet 12.

Figure 2:
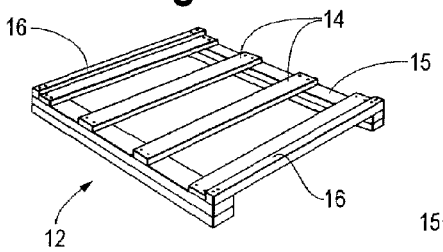
FIG. 2 is a perspective view of a shipping pallet which forms part of the unitary packaging assembly of FIG. 1.
Figure 3:
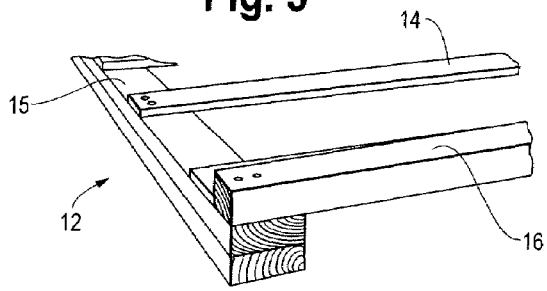
FIG. 3 is a partial close up view of the shipping pallet of FIG. 2.

As shown in FIGS. 2 and 3, the shipping pallet 12 comprises a load bearing surface defined by a plurality of load bearing cross members 14 arranged in parallel and secured at opposing to parallel side runners 15. The basic shipping pallet 12 may be modified as shown by affixing to the opposing front and rear ends of the shipping pallet 12 parallel, elongated, spaced apart front and rear stops 16. The front and rear stops 16 may be attached to the side runners 15 either directly, as shown in FIG. 3, or indirectly by being attached to the load bearing cross members 14. Further, the front and rear stops 16 may be oriented perpendicular to the runners 15 as shown in the figures or parallel thereto.

As explained below, the front and rear stops 16 help prevent forward or rearward movement of the carton 32 and transport base 18 relative to the shipping pallet 12. The shipping pallet may be made from wood or any other suitable material. Preferably the load bearing surface is raised off the ground to enable the packaging assembly 10 to be moved with a fork lift truck.

Figure 4:
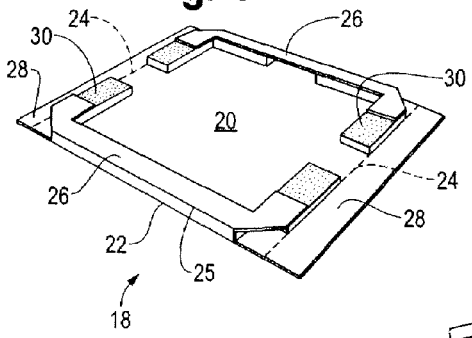
FIG. 4 is a perspective view of a transport base which forms part of the unitary packaging assembly of FIG. 1.
Figure 5:
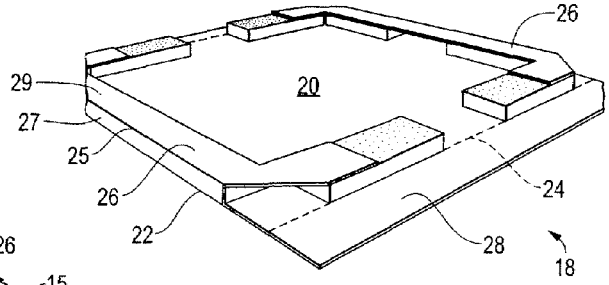
FIG. 5 is another perspective view of the transport base of FIG. 4.
Figure 6:
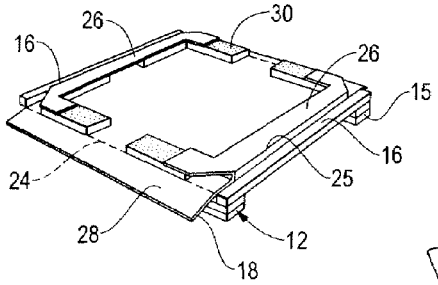
FIG. 6 is a perspective view of the transport base of FIG. 4 shown resting on the shipping pallet of FIG. 2.
Figure 7:
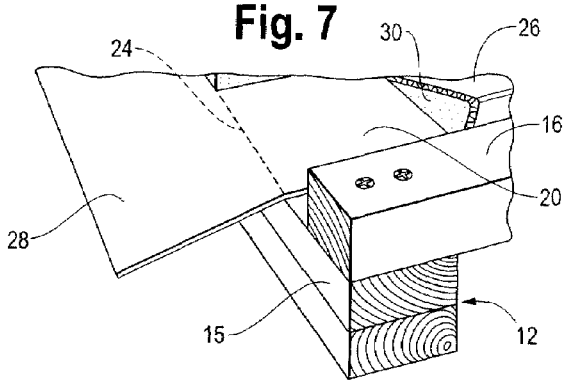
FIG. 7 is a partial close up view of the transport base and shipping pallet of FIG. 6.

Referring now to FIGS. 4 and 5, the transport base 18 that serves as the bottom of the carton 32 and rests on the shipping pallet 12 comprises a flat (planar) bottom panel 20 having a perimeter defined by first and second sets of opposing fold lines 24, 2, front and rear panels 26 hingedly attached to the bottom panel 20 along the second set of opposing fold lines 22, side panels 28 hingedly attached to the bottom panel 20 along the first set of opposing fold lines 24, and two or more load bearing cushioning elements 30 arranged in spaced relation near the perimeter of and affixed to the bottom panel 20.

The cushioning elements 30 may be positioned in any suitable locations on the bottom panel 20, but preferably they are spaced around the perimeter of the bottom panel near the corners so that the article 50 rests on the encapsulated cushioning elements 30. In the embodiment illustrated in the figures two cushioning elements 30 are placed at each corner of the bottom panel 20 for a total of eight cushioning elements 30. Each pair of cushioning elements 30 at each corner are positioned at right angles to each other alongside adjoining orthogonal fold lines 22, 24 and are spaced away from their mutual corner in order to leave space to accommodate corner posts 17.

Still referring to FIGS. 4 and 5, the front and rear panels 26 are configured to partially encapsulate the cushioning elements 30 by folding each front and rear panel 26 up and over the cushioning elements 30. Specifically, each front and rear panel 26 comprises a side wall 27 foldably connected to the transport base bottom panel 20 along first fold line 22 and a top wall 29 connected to the side wall 27 along a third fold line 25. In order to encapsulate the cushioning elements 30, the front and rear panels 26 are folded upward along second fold lines 22 at a ninety degree angle and then inward (toward each other) along third fold lines 25 at a ninety degree angle to cover at least a portion of the outer facing sides and tops of the cushioning elements 30. The side walls 27 and top walls 29 may be glued or otherwise affixed to the sides and tops of the cushioning elements 30. As shown in the figures, the top walls 29 are substantially U-shaped to at least partially encapsulate (cover) all eight cushioning elements 30, and are beveled (cut at an angle relative to the corners of the transport base 18) to accommodate the corner posts 17.

Figure 8:
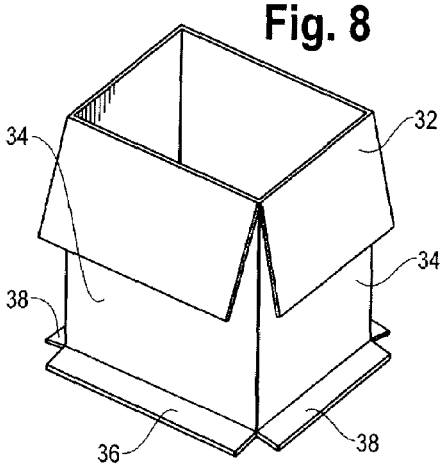
FIG. 8 is a perspective view of a carton which forms part of the unitary packaging assembly of FIG. 1.

Referring to FIGS. 1 and 8, the shipping carton 32 comprises four vertical side walls 34, top flaps 40 and four relatively narrow bottom flaps 36, 38. The bottom flaps 36, 38 comprise front and rear flaps 36 and side flaps 38 and do not function as the carton bottom, at least not by themselves. Rather, as explained below, the carton front and rear flaps 36 cooperate with the transport base 18 to form the carton bottom. More specifically, in the assembled packaging unit 10, the carton front and rear flaps 36 are tucked under the transport base 18 between the transport base 18 and the shipping pallet 12 (see FIGS. 9 and 11) while the side flaps 38 extend downward in roughly the same plane as the carton side walls 34 and are stapled to the pallet runners 15 (see FIG. 12).

The corner posts 17 shown in FIG. 1 are disposed within the carton 32 adjacent the inner corners of the carton 32 to provide for corner impact protection and axial strength. The corner posts 17 can be conventional corner posts of the type manufactured and marketed by Sonoco Products Company of Hartsville, S.C. However, any suitable support structures may be used for corner impact protection and axial strength, including without limitation angle board.

The unitary palletized packaging assembly 10 of the present invention may be assembled and used in the following manner.

First, the composite transport base 18 is assembled by positioning the cushioning elements 30 on the bottom panel 20 as shown in FIG. 1, then folding the front and rear panels 26 up and over the cushioning elements 30 to form the transport base 18 shown in FIGS. 4 and 5. The side panels 28 may be left extending outward approximately within the same plane as the bottom panel 20.

Next, the article 50 to be assembled and transported is placed on the transport base 12, typically as the article 50 moves along a manufacturing assembly line. In the illustrated embodiment, the article is an outdoor air conditioning unit 50 having an embossed (protruding) bottom (not shown) that fits within the three dimensional space defined by the cushioning elements 30 and the bottom panel 20. The air conditioner frame or housing rests on the top walls 29 covering the cushioning elements 30. The transport base top panels 29 are thus positioned underneath the article 50 while the transport base side panels 28 remain extended outward.

Next, an open bottomed shipping carton 32 is placed over the article 50 and the transport base 18. At this stage in the assembly of the final packaging unit 10 the carton bottom flaps 36, 38 may be splayed outward as shown in FIG. 8.

Corner posts 17 with optional corner posts caps 19 are then inserted adjacent the inside corners of the carton 32 between the carton 32 and the article 50. An optional top frame 21 may be secured to the corner posts top caps 19. The corner posts bottom ends rest on the transport base bottom panel 20 near the corners of the bottom panel 20. If the optional caps 19 and top frame 21 are used, the corner posts 17, top caps 19 and top frame 21 together extend the full height of the carton 32. If the optional caps 19 and top frame 21 are not used, the corner posts 17 extend the full height of the carton 32.

As the article 50, carton 32 and transport base 18 continue to move along the conveyor line the carton front (leading) and rear (trailing) flaps 36 may be automatically folded underneath the transport base 18 and may or may not be secured to the underside of the transport base bottom panel 20. The carton side flaps 38 remain splayed outward, overlaying the still outwardly extending transport base side panels 28.

Figure 9:
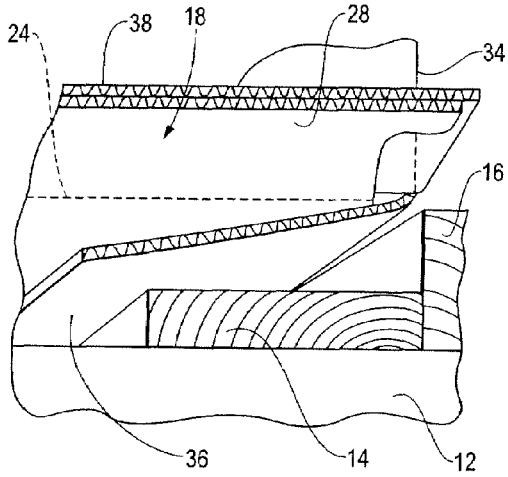
FIG. 9 is a partial close up view of the carton and transport base of FIGS. 4 and 8 being placed onto the shipping pallet of FIG. 2.

At the end of the conveyor line the article 50, carton 32 and transport base 18 are lifted up together and placed on a shipping pallet 12. The carton 32 and transport base 18 are wedged between the front and rear stops 16 of the shipping pallet 12 as shown in FIGS. 9-12 to prevent forward and rearward movement of the carton 32 and transport base 18. As best shown in FIGS. 9 and 11, the carton front and rear bottom flaps 36 remain folded under the transport base 18 and are interposed (sandwiched) between the transport base 18 and the shipping pallet 12.

Figure 10:
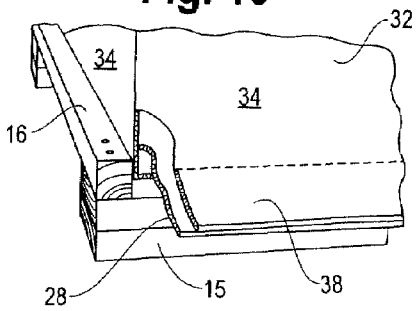
FIG. 10 is a partial close up view of the carton and transport base resting on the shipping pallet.
Figure 11:
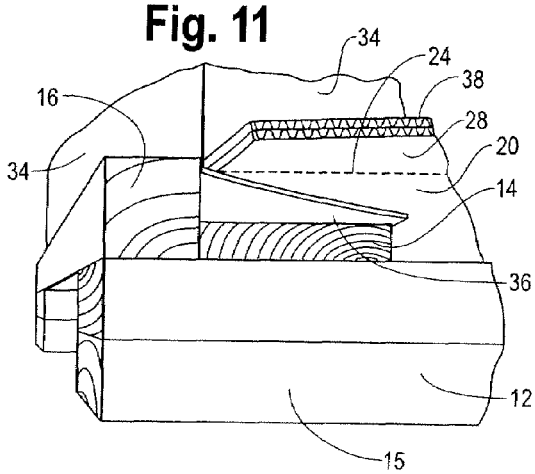
FIG. 11 is another partial close up view of the carton and transport base resting on the shipping pallet.
Figure 12:
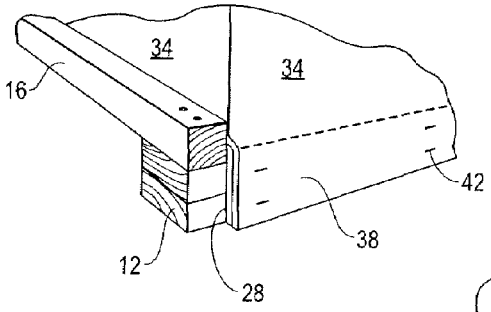
FIG. 12 is still another partial close up view of the carton and transport base resting on the shipping pallet, shown with a carton bottom flap and transport base side flange folded downward and stapled to the side of the shipping pallet.

The carton side flaps 38, which have been splayed outward over the transport base side panels 28 as shown in FIG. 10, are then folded downward so that the transport base side panels 28 are interposed between the pallet side runners 15 and the carton side flaps 38 as shown in FIG. 12. The carton side flaps 38 and side panels 28 are then removably secured to the shipping pallet runners 15 by staples 42 or other means.

Figure 13:
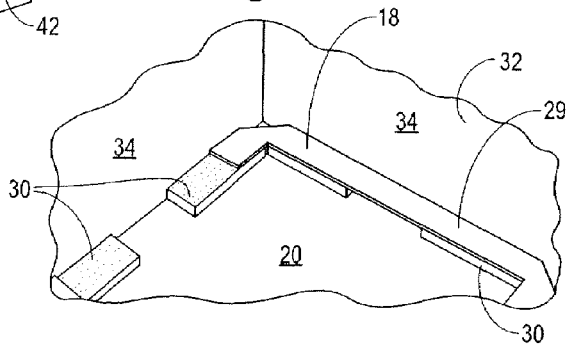
FIG. 13 is an interior view of the assembled carton, transport base and shipping pallet of FIG. 12, shown without the packaged article or interior corner posts.

FIG. 13 is a view of the inside of the carton 32 (without the article 50 or corner posts 17), showing how the transport base 18 serves as the bottom of the package on which the article 50 rests.

Finally, the carton top flaps 40 are folded together to complete the packaging assembly 10. The finished packaging assembly 10 is unitary in the sense that the carton 32, transport base 18 and shipping pallet 12 are secured together by the staples 42 and, to a lesser extent, by the fit of the carton 32 and transport base 18 between the shipping pallet end stops 16. The corner posts 17, with or without the caps 19 and top frame 21, extend from the transport base bottom panel 20 to the carton top flaps 40 and provide sufficient axial (vertical) strength to allow other packaging units 10 to be stacked on top.

Thus there has been described a unitary packaging assembly 10 comprising a shipping pallet 12, a transport base 18 resting on the pallet 12, a shipping carton 32 enclosing the packaged article 50, and corner posts 17 inserted between the carton 32 and the packaged article 50. In a key aspect of the invention the transport base 18 and shipping carton 32 are both secured to the shipping pallet 12 to prevent lateral movement of the packaged article 50 relative to the shipping pallet 12. The transport base 18 may be made from composite materials, such as paperboard and expanded polystyrene foam (EPS). The corner posts 17 may be made from paperboard and the carton 32 may be made from corrugated board. Of course, any suitable materials may be used for the various packaging assembly components.

It is understood that the embodiments of the invention described above are only particular examples which serve to illustrate the principles of the invention. Modifications and alternative embodiments of the invention are contemplated which do not depart from the scope of the invention as defined by the foregoing teachings and appended claims. It is intended that the claims cover all such modifications and alternative embodiments that fall within their scope.

We claim as our invention:

1. An assembly for packaging an article, the assembly comprising: a shipping pallet having a load bearing surface supported by parallel, spaced apart, side runners; a substantially rectangular transport base resting on the shipping pallet load bearing surface and comprising a bottom panel having four corners and a perimeter partly defined by first opposing fold lines, and side panels hingedly attached to the bottom panel along the first opposing fold lines; and a carton surrounding the transport base and comprising four side walls having bottom edges and four bottom flaps foldably attached to the carton side wall bottom edges, the bottom flaps comprising front and rear flaps and two side flaps, the front and rear flaps being folded under the transport base and interposed between the transport base and the shipping pallet, the side flaps extending downward; wherein the transport base side panels extend downward and are interposed between the pallet side runners and the carton side flaps, and wherein the carton side flaps and transport base side panels are secured to the pallet side runners; wherein the transport base bottom panel perimeter is further defined by second opposing fold lines, and wherein the transport base further comprises front and rear panels hingedly attached to the bottom panel along the second opposing fold lines; wherein the transport base further comprises a plurality of load bearing cushioning elements arranged in spaced relation on the bottom panel near its perimeter; and wherein the front and rear panels at least partially encapsulate the cushioning elements.

2. The assembly of claim 1 wherein each front and rear panel comprises a side wall foldably connected to the transport base bottom panel along one of the second opposing fold lines and a top wall foldably connected to the side wall along a third fold line.

3. The assembly of claim 2 wherein each transport base side wall extends upward from one of the second opposing fold lines substantially perpendicular to the bottom panel and each top wall extends horizontally inward from one of the third fold lines, and wherein each of the top walls covers at least a portion of the cushioning elements.

4. The assembly of claim 3 wherein the top walls are affixed to one or more of the cushioning elements.

5. The assembly of claim 4 further comprising corner posts disposed within the carton.

6. The assembly of claim 5 wherein cushioning elements are disposed near each corner of the bottom panel and are spaced away from each corner a distance sufficient to accommodate the corner posts.

7. An assembly for packaging an article, the assembly comprising: a shipping pallet having a load bearing surface supported by parallel, spaced apart, side runners; a substantially rectangular transport base resting on the shipping pallet load bearing surface and comprising a bottom panel having four corners and a perimeter partly defined by first opposing fold lines, and side panels hingedly attached to the bottom panel along the first opposing fold lines; and a carton surrounding the transport base and comprising four side walls having bottom edges and four bottom flaps foldably attached to the carton side wall bottom edges, the bottom flaps comprising front and rear flaps and two side flaps, the front and rear flaps being folded under the transport base and interposed between the transport base and the shipping pallet, the side flaps extending downward; wherein the transport base side panels extend downward and are interposed between the pallet side runners and the carton side flaps, and wherein the carton side flaps and transport base side panels are secured to the pallet side runners; wherein the shipping pallet further comprises elongated, spaced apart, front and rear stops affixed to the side runners, and wherein a bottom portion of the carton and at least a portion of the transport base are located between the front and rear stops.

8. The assembly of claim 1 wherein the bottom portion of the carton and the at least a portion of the transport base are wedged between the front and rear stops.

9. The assembly of claim 7 wherein the shipping pallet load bearing surface is defined by a plurality of spaced apart cross members affixed to the side runners.

10. The assembly of claim 9 wherein the front and rear stops are directly attached to the side runners and are oriented perpendicular to the side runners.

11. The assembly of claim 1 wherein the carton side flaps and transport base side panels are secured to the pallet side runners by staples.

* * * * *

UNITED STATES PATENT AND TRADEMARK OFFICE

CERTIFICATE OF CORRECTION

PATENT NO. : 7,654,390 B2
APPLICATION NO. : 11/737383
DATED : February 2, 2010
INVENTOR(S) : James R. Baechle, Matthew Marrow and Edward L. Lamb It is certified that error appears in the above-identified patent and that said Letters Patent is hereby corrected as shown below:

Title Page; item (75);

Delete name of inventor "Edward L. Lake" and replace with --Edward L. Lamb--.

Signed and Sealed this

Twenty-third Day of March, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,654,390 B2
APPLICATION NO. : 11/737383
DATED : February 2, 2010
INVENTOR(S) : James R. Baechle, Matthew Morrow and Edward L. Lamb It is certified that error appears in the above-identified patent and that said Letters Patent is hereby corrected as shown below:

Col. 7, in claim 8, line 4, delete "of claim 1" and replace with --of claim 7--.

Signed and Sealed this
Fourteenth Day of February, 2012

David J. Kappos

David J. Kappos
*Director of the United States Patent and Trademark Office*